US009249539B2

(12) United States Patent
Hubig et al.

(10) Patent No.: US 9,249,539 B2
(45) Date of Patent: Feb. 2, 2016

(54) DETERMINATION OF DRYNESS OF TEXTILES IN A DRYER

(75) Inventors: Stephan M. Hubig, Maplewood, MN (US); Stephen X. Skaff, Eagan, MN (US); Monica P. Tindel-Koukal, Burnsville, MN (US); Mihnea A. Popa, Roseville, MN (US); Russell D. Maziarka, Richfield, MN (US)

(73) Assignee: Ecolab Inc., St. Paul, MN (US)

( * ) Notice: Subject to any disclaimer, the term of this patent is extended or adjusted under 35 U.S.C. 154(b) by 1870 days.

(21) Appl. No.: 11/526,515

(22) Filed: Sep. 25, 2006

(65) Prior Publication Data

US 2008/0072448 A1 Mar. 27, 2008

(51) Int. Cl.

| | |
|---|---|
| ***D06F 58/04*** | (2006.01) |
| ***D06F 58/20*** | (2006.01) |
| ***D06F 58/28*** | (2006.01) |
| ***A47L 15/00*** | (2006.01) |
| ***A47L 15/46*** | (2006.01) |

(52) U.S. Cl.

CPC ..... *D06F 58/28* (2013.01); *A47L 15/0034* (2013.01); *A47L 15/46* (2013.01); *A47L 2401/18* (2013.01); *A47L 2401/19* (2013.01); *A47L 2501/265* (2013.01); *A47L 2501/34* (2013.01); *D06F 2058/2819* (2013.01); *D06F 2058/2829* (2013.01)

(58) Field of Classification Search

CPC ..... A47L 2401/19; A47L 2501/265; A47L 2501/34; D06F 2058/2819; D06F 2058/2829

USPC ..... 34/86, 491, 493, 524, 550, 557

See application file for complete search history.

(56) References Cited

U.S. PATENT DOCUMENTS

| | | | |
|---|---|---|---|
| 2,717,455 | A | 9/1955 | Harris et al. |
| 3,510,957 | A | 5/1970 | Jarvis |
| 3,870,145 | A | 3/1975 | Mizuno |
| 4,019,259 | A | 4/1977 | Veraart |
| 4,385,452 | A | 5/1983 | Deschaaf et al. |
| 4,481,786 | A | 11/1984 | Bashark |

(Continued)

FOREIGN PATENT DOCUMENTS

| | | | |
|---|---|---|---|
| DE | 19611324 | A1 | 10/1996 |
| DE | 19611324 | C2 | 2/1999 |

(Continued)

OTHER PUBLICATIONS

English translation of KR 1020050118484.*

(Continued)

*Primary Examiner* — Jiping Lu

(74) *Attorney, Agent, or Firm* — Shumaker & Sieffert, P.A.

(57) ABSTRACT

A dryer monitor detects when textiles in a dryer are dry, detects when textiles in a dryer are overdry, and/or may count dryer cycles. The dryer monitor includes a humidity sensor, a temperature sensor, a controller and various status indicators. The humidity and temperature sensors may be located outside the drying compartment of the dryer. In the case of a clothes dryer, the humidity and temperature sensors may be located outside the drum of the dryer and may be located, for example, in the exhaust compartment of the dryer. The dryer monitor determines dryness of items in the dryer, and may also determine whether the items are overdry, based on humidity information received from the humidity sensor. The dryer monitor counts dryer cycles based on temperature information received from the temperature sensor.

23 Claims, 4 Drawing Sheets

(56) References Cited

U.S. PATENT DOCUMENTS

| | | | | | |
|---|---|---|---|---|---|
| 4,549,362 | A | * | 10/1985 | Haried | 34/395 |
| 4,763,425 | A | * | 8/1988 | Grennan | 34/552 |
| 4,827,627 | A | | 5/1989 | Cardoso | |
| 5,050,313 | A | * | 9/1991 | Wakaeya et al. | 34/454 |
| 5,166,592 | A | | 11/1992 | Bashark | |
| 5,193,292 | A | | 3/1993 | Hart et al. | |
| 5,281,956 | A | | 1/1994 | Bashark | |
| 5,347,727 | A | | 9/1994 | Kim | |
| 5,412,291 | A | | 5/1995 | Payne et al. | |
| 5,560,124 | A | | 10/1996 | Hart et al. | |
| 5,675,911 | A | | 10/1997 | Moser | |
| 5,682,684 | A | | 11/1997 | Wentzlaff et al. | |
| 5,852,881 | A | | 12/1998 | Kuroda et al. | |
| 6,061,668 | A | | 5/2000 | Sharrow | |
| 6,104,987 | A | | 8/2000 | Farnsworth | |
| 6,122,840 | A | | 9/2000 | Chbat et al. | |
| 6,446,357 | B2 | | 9/2002 | Woerdehoff et al. | |
| 6,484,417 | B2 | | 11/2002 | Tedman et al. | |
| 6,493,963 | B1 | | 12/2002 | England | |
| 6,519,871 | B2 | | 2/2003 | Gardner et al. | |
| 6,745,496 | B2 | | 6/2004 | Cassella | |
| 6,775,923 | B2 | | 8/2004 | Do | |
| 6,779,740 | B1 | | 8/2004 | Lentsch et al. | |
| 6,845,290 | B1 | | 1/2005 | Wunderlin et al. | |
| 6,910,640 | B2 | | 6/2005 | Griese et al. | |
| 6,931,759 | B2 | | 8/2005 | Jeong et al. | |
| 6,931,760 | B2 | | 8/2005 | Yang | |
| 6,968,632 | B2 | | 11/2005 | Guinibert et al. | |
| 6,988,375 | B2 | | 1/2006 | Bashark | |
| 7,005,618 | B2 | | 2/2006 | Riddle et al. | |
| 7,313,874 | B2 | | 1/2008 | Park | |
| 7,412,783 | B2 | | 8/2008 | Guinibert et al. | |
| 7,478,486 | B2 | | 1/2009 | Wunderlin et al. | |
| 7,526,956 | B2 | | 5/2009 | Muzzolini | |
| 7,594,343 | B2 | | 9/2009 | Woerdehoff et al. | |
| 7,971,371 | B2 | | 7/2011 | Beaulac | |
| 8,782,922 | B2 | | 7/2014 | May et al. | |
| 2002/0174564 | A1 | | 11/2002 | England | |
| 2003/0034443 | A1 | | 2/2003 | Kouznetsov et al. | |
| 2003/0195130 | A1 | | 10/2003 | Lentsch et al. | |
| 2004/0123486 | A1 | | 7/2004 | Hameed et al. | |
| 2004/0168343 | A1 | | 9/2004 | Park | |
| 2005/0066999 | A1 | | 3/2005 | Dietz et al. | |
| 2005/0091875 | A1 | | 5/2005 | Kim | |
| 2005/0091876 | A1 | | 5/2005 | Yang | |
| 2005/0183209 | A1 | | 8/2005 | Costa et al. | |
| 2006/0191161 | A1 | | 8/2006 | Wunderlin et al. | |
| 2007/0256321 | A1 | | 11/2007 | Bae et al. | |
| 2008/0072448 | A1 | | 3/2008 | Hubig et al. | |
| 2008/0104860 | A1 | | 5/2008 | Muenzner et al. | |
| 2008/0184588 | A1 | * | 8/2008 | Somod et al. | 34/495 |
| 2008/0264111 | A1 | | 10/2008 | Giordano | |
| 2009/0126220 | A1 | | 5/2009 | Nawrot et al. | |
| 2013/0091728 | A1 | | 4/2013 | Morin et al. | |

FOREIGN PATENT DOCUMENTS

| | | | |
|---|---|---|---|
| EP | 0 709 516 | A1 | 5/1996 |
| EP | 0 816 551 | A2 | 1/1998 |
| EP | 0 863 244 | A2 | 9/1998 |
| JP | 4039000 | A | 2/1992 |
| JP | 4109999 | A | 4/1992 |
| JP | 4-285599 | A | 10/1992 |
| JP | 5115688 | A | 5/1993 |
| JP | 10043498 | A | 2/1998 |
| JP | 10197152 | A | 7/1998 |
| JP | 11235499 | A | 8/1999 |
| JP | 2001194067 | A | 7/2001 |
| JP | 2004321766 | A | 11/2004 |
| JP | 2008194153 | A | 8/2008 |
| KR | 10-1995-0018837 | A | 7/1995 |
| KR | 10-2002-0076590 | A | 10/2002 |
| KR | 10-2004-0110812 | A | 12/2004 |
| KR | 10-2005-0118484 | A | 12/2005 |
| KR | 100962315 | B1 | 6/2010 |
| WO | 2008049534 | A1 | 5/2008 |

OTHER PUBLICATIONS

PCT International Search Report and PCT Written Opinion from corresponding PCT Application No. PCT/IB2007/053893, mailed Apr. 30, 2008 (18 pages).

English translation of Unexamined Patent Publication No. KR 10-2002-0076590, entitled, "Method and Apparatus for Controlling Drying of Drying Machine", published Oct. 11, 2002, Applicant: LG Electronics, Inc., 16 pages.

Response to Office Action dated Aug. 16, 2013, from U.S. Appl. No. 12/954,006, filed Nov. 18, 2013, 10 pp.

Office Action from U.S. Appl. No. 13/273,805, dated Dec. 31, 2014, 4 pp.

Office Action from U.S. Appl. No. 13/273,805, dated Apr. 15, 2015, 5 pp.

Genskow et al., "Psychrometry, Evaporative Cooling, and Solids Drying," Perry's Chemical Engineer' Handbook, Eighth Edition, Section 12, Oct. 26, 2007, pp. 12-1, 12-5,12-14.

Karmakar et al., "Novel Feature for Quantifying Temporal Variability of Poincare Plot: A Case Study," Biomed Eng Online, Aug. 13, 2009, 4 pp.

Koebbe et al., "Use of Recurrence Plots in the Analysis of Time-Series Data," University of California—Santa Cruz; Rush—Pres.—St. Luke's Medical Center, Chicago, IL Sep. 29, 1994, 7 pp.

Office Action from U.S. Appl. No. 13/273,805, dated Oct. 8, 2014, 9 pp.

Prosecution History from U.S. Pat. No. 8,782,922, dated Aug. 16, 2013 through Mar. 13, 2014, 26 pp.

Notice of Allowance from U.S. Appl. No. 13/273,805, dated Jul. 30, 2015, 8 pp.

Amendment in Response to Office Action mailed Oct. 8, 2014, from U.S. Appl. No. 13/273,805, filed Dec. 8, 2014, 10 pp.

* cited by examiner

DETERMINATION OF DRYNESS OF TEXTILES IN A DRYER

TECHNICAL FIELD

The invention relates to a dryer monitor for a dryer for drying wet articles, and, more particularly, to a dryer monitor incorporating humidity and/or temperature sensors to determine dryness of textiles in a clothes dryer.

BACKGROUND

Conventional clothes dryers include a rotating drum into which textiles to be dried are placed. The textiles are dried by forcing heated air onto the wet laundry rotating with the drum. Moisture is removed along with the air exiting the dryer or via a condensed water duct.

Conventional clothes dryers have been controlled in various ways. The simplest of these is a timer that controls the duration of the drying cycle. When using a timer, the user places wet laundry inside the dryer and selects the duration for the drying process. The drying cycle then proceeds until the timer expires. Although this method is relatively simple, it is difficult to accurately estimate the length of time required to reach a desired final moisture level, or "dryness," for every type of textile. If the cycle length is too short, the textiles will not be fully dry at the end of the cycle, and the user must initiate a another dryer cycle to finish the drying process. If, on the other hand, the cycle length is too long, the clothes may become "overdry," resulting in premature textile degradation and/or damage, excess energy consumption, and an associated increase in energy costs.

Alternatively, various sensors that detect the "dryness" of the textiles within the dryer have been used to control the length of the dryer cycle. In that case, the dryer cycle runs until the sensor detect the final desired dryness level selected by the user. Such sensors are typically placed inside the dryer drum and come into contact with the textiles as they are tumbled through the dryer cycle. However, not all dryers, especially commercial dryers, are equipped with this type of sensor.

In addition, laundry additives are commonly applied to laundry during the dryer cycle. Certain of these laundry additives are designed to provide automatic dispensing of laundry products over multiple cycles. These products provide multiple-load functionality and minimal labor as they reduce the need to replace or refill a laundry product at the beginning of each cycle. One example of a multi-cycle laundry product includes solid blocks of fabric conditioner that are mounted in a carrier inside the drum of the dryer. The block provides moisture-controlled dispensing of the active ingredients on wet textiles as they tumble in the dryer. As soon as the textiles are dry, the product is no longer dispensed. The block dispenses the laundry product over multiple loads until is depleted, at which point the solid block of product must be replaced. Other examples of multi-cycle laundry products include dryer sheets, free-tumbling carriers of liquid fabric conditioner, and others.

SUMMARY

In general, the invention is related to a dryer monitor that may detect when textiles in a dryer are dry, detect when textiles in a dryer are overdry, and/or count dryer cycles.

In one embodiment, the invention is directed to a device including a humidity sensor that senses humidity information concerning humidity levels associated with a dryer, and a controller that determines dryness of items in the dryer based on the received humidity information. The invention may further include a temperature sensor that senses temperature information concerning a temperature associated with the dryer. The controller may further count dryer cycles of the dryer.

In another embodiment, the invention is directed to a method including receiving humidity information associated with a dryer and determining dryness of items in the dryer based on the received humidity information.

In another embodiment, the invention is directed to a computer-readable medium containing instructions. The instructions cause a programmable processor to receive humidity information associated with a dryer, and determine dryness of items in the dryer based on the received humidity information.

The details of one or more embodiments of the invention are set forth in the accompanying drawings and the description below. Other features of the invention will be apparent from the description and drawings, and from the claims.

DETAILED DESCRIPTION

Figure 1:
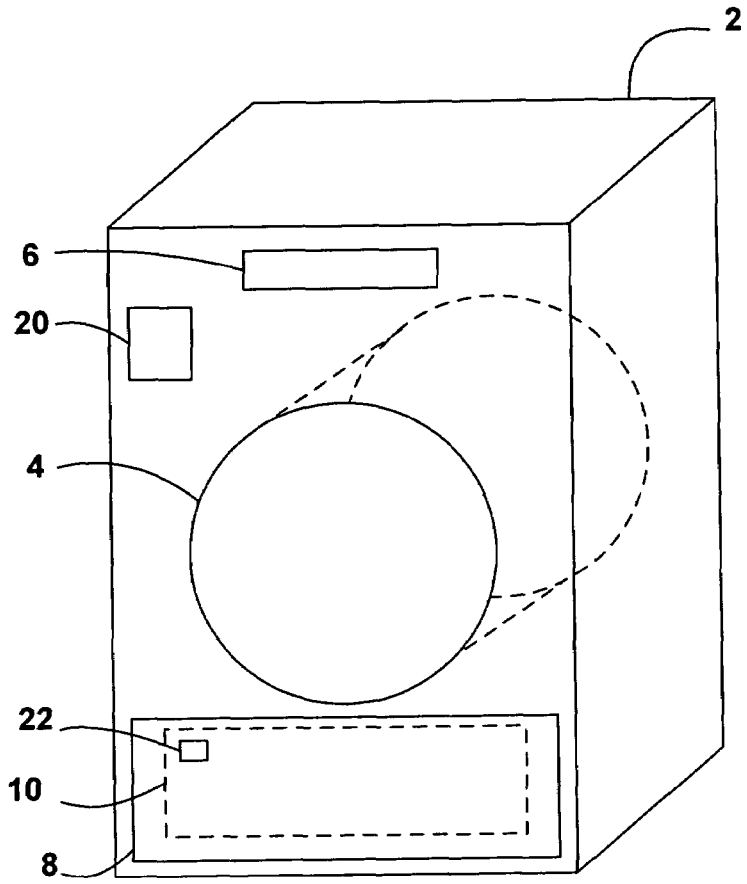
FIG. 1 is a block diagram illustrating an example embodiment of a dryer monitor of the present invention mounted on a clothes dryer.

FIG. 1 is a block diagram illustrating an example embodiment of a clothes dryer 2 and a dryer monitor 20. Although in FIG. 1 dryer monitor 20 is shown mounted to the front of dryer 2, it shall be understood that the dryer monitor 20 may be positioned at some other location, such as on any other location on dryer 2, on a wall, in a central control area or at any other designated location. Dryer 2 includes a rotatable drum 4 in which textiles to be dried are placed. A control panel 6 includes the various dials, knobs, indicia and other elements through which a user controls operation of dryer 2. Control panel 6 may include any of the known conventional dryer controls, such as a start/stop button, a timed dry dial, a heat level selector (e.g., high, medium, low, none) and/or a fabric-type selector (e.g., heavy duty, regular, delicate). Sensors 22 sense textile dryness information and/or cycle start information. Sensors 22 may be located outside the drying compartment of the dryer. In the case of the clothes dryer as shown in FIG. 1, sensors 22 may be located outside drum 4 of dryer 2. In one embodiment, for example, sensors 22 are positioned to sense textile dryness information and/or cycle start information of exhaust air of the clothes dryer. For example, dryer 2 includes an exhaust compartment 8 having a lint filter 10 located therein. In one embodiment, sensors 22 are placed within the exhaust compartment 8. The sensors may be placed on the outbound side of lint filter 10 to help ensure that lint from the dryer does not interfere with operation of sensors 22.

In a commercial setting, such as a hotel, hospital, laundry service or other setting in which large numbers of dryers and are run through multiple cycles each day, several factors come into play. For example, textiles in a dryer should be dried to the point where they are "dry" but not "overdry." To that end, dryer monitor 20 notifies laundry personnel when the textiles within dryer 2 are "dry" and/or may also notify laundry personnel when the textiles in dryer 2 are "overdry." By doing so, dryer monitor 20 may increase efficiency because employees need not run the dryer through an additional cycle to make sure the laundry is dry. In addition, by determining when textiles in a dryer are dry and alerting laundry personnel of that fact, dryer monitor 20 may result reduce excess energy consumption by helping to minimize the amount of time a dryer spends drying the textiles after a desired dryness level has been achieved.

As another example, certain laundry products may be used to condition textiles in the dryer during the dryer cycle. These include single-use laundry products, such as dryer sheets, and multi-use laundry products, such as solid blocks of fabric softener or other laundry conditioners that are gradually used up over the course of several dryer cycles. Examples of multi-use solid product blocks and associated carriers may be found in U.S. Pat. No. 6,779,740 to Lentsch, et al., issued Aug. 24, 2004; in U.S. Pat. No. 6,910,640 to Griese, et al., issued Jun. 28, 2005; and in U.S. Patent Application Publication Number 2003/0195130, to Lentsch, et al., published Oct. 16, 2003, each of which is incorporated herein by reference in its entirety. In the case of multi-use laundry products, dryer monitor 20 may also notify laundry personnel when these multi-use laundry products need to be replaced. Dryer monitor 20 may thus help to ensure that each load of laundry receives the proper amount of fabric conditioning by avoiding situations in which a dryer is run through one or more cycles with no fabric conditioning product.

To provide the dryness information and the replacement information, dryer monitor 20 includes at least one sensor 22. Information obtained from sensor 22 is used as a gauge to determine the dryness of textiles in dryer 2. Sensor 22 may include a humidity sensor, a temperature sensor or both. Sensor 22 may also include any other type of sensor that senses information concerning dryness or overdryness of textiles in a dryer, or which senses information concerning the start or stop of a dryer cycle. When the specified level of dryness is sensed, dryer monitor 20 may alert the customer to prevent needless over-drying of the textiles. Preventing overdry textiles may help to conserve energy, reduce excess energy costs and prevent premature textile degradation and/or damage. Information obtained from sensor 22 may also be used to count the number of cycles of dryer 2. The dryer cycle count may be used, for example, to alert laundry personnel when it is time to replace multi-cycle laundry products, to indicate when periodic or scheduled maintenance is to take place, to track the number of dryer cycles executed by the dryer over the lifetime of the dryer or during a defined period of time, etc.

Although dryer monitor 20 will be shown and described herein with respect to a clothes dryer, it shall be understood that dryer monitor 20 may be used with any type of drying equipment, and the invention is not limited in this respect. Such drying equipment may include, for example, dishwashers, warewashers, car washes, or other equipment where drying of an object or objects is required. In addition, dryer monitor 20 may be used to monitor and/or alarm to temperature, humidity or other environmental conditions in any application where such monitoring is required or desired. As with the clothes dryer embodiment shown in FIG. 1, the sensors 22 may be located outside the drying compartment, of the drying equipment, and/or may be positioned to sense dryness information and/or cycle start information of exhaust air of the drying equipment.

When dryer monitor 20 is first installed for use with an existing dryer in a commercial laundry setting, such as a hotel or commercial laundry establishment, it may be run using various default settings that may be programmed into dryer monitor 20 at the time of manufacture. Alternatively, dryer monitor 20 may be configured with customized settings by a service technician at the time of installation or at some later time. For example, a service technician may configure dryer monitor 20 by determining and setting customized settings for when the laundry is "dry," when the laundry is "overdry," when a dryer cycle starts and/or stops, and/or a maximum number of dryer cycles after which an alert is to be activated. By comparing the sensed humidity and or temperature information from sensor 22 with the programmed default or customized settings, dryer monitor 20 may determine the status (e.g., whether the laundry is not dry, dry or overdry) of the laundry and/or may count dryer cycles. Dryer monitor 20 may then indicate via a status indicator, such as a visible or audible alarm, when the laundry is dry, when the laundry is "overdry" and/or when the specified number of dryer cycles has elapsed. Dryer monitor 20 may also determine and display a count of the number of dryer cycles that have occurred over the lifetime of the dryer or during a defined period of time.

Figure 2:
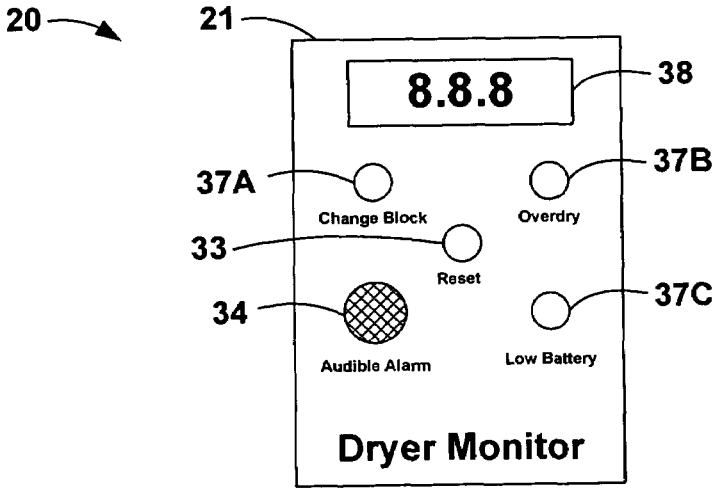
FIG. 2 is a front view illustrating an example physical embodiment of a control panel for dryer monitor 20.

FIG. 2 is a front view illustrating an example physical embodiment of a control panel for dryer monitor 20. Although FIG. 2 shows a specific physical layout of various visual and audible status indicators and user-actuatable elements such as buttons or switches, it shall be understood that the invention is not limited in this respect, and that any physical layout may be used without departing from the scope of the present invention.

In the example embodiment shown in FIG. 2, dryer monitor 20 is enclosed in a housing 21, and includes various visual and audible status indicators and user-actuatable elements for communication with a user. For example, dryer monitor 20 may include a display 38. Display 38 may include a push button to switch between displays of two or more different pieces of status information. Namely, display 38 may switch between a default display of the number of dryer cycles remaining before any multi-cycle laundry product is to be replaced and the total number of overdried loads that have occurred over a defined time period. Alternatively, display 38 may incorporate any desired numerical status information, text messages, etc. Dryer monitor 20 may also include several other status indicators 37, such as a change indicator 37A, an overdry indicator 37B and/or a low battery indicator 37C. Status indicators 37 may be implemented using LEDs, alarms or any other suitable visible or audible indicator. An audible alarm 34 such as a beeper or buzzer may also be included.

For example, when the maximum number of dryer cycles is reached, dryer monitor may activate change indicator 37A and/or audible alarm 34. For example, change indicator 37A may light up or blink after a predetermined number of dryer cycles have been completed. At this point in time, the cycle count on display 38 might read "0" in the event that the display counts down from the maximum number of dryer cycles. A displayed cycle count of "0" in this instance may alert laundry personnel that it is time to replace the multi-cycle laundry product or perform preventive maintenance, for example.

In addition, when dryer monitor 20 determines that the textiles within the dryer have been "dry" for a certain length of time it may activate overdry indicator 37B. For example, overdry indicator 37B may light up or blink in a certain way when the linen has been determined to be "dry" for at least a defined number of minutes to alert the laundry staff to stop the dryer cycle and prevent an overdry condition. Alternatively or in addition, once dryer monitor 20 has determined that the dryer is operating in an "overdry" condition, overdry indicator 37B may light up or blink in a different way to alert the laundry staff of the overdry condition. Dryer monitor 20 may also track and/or display the amount of time the dryer operates in an overdry condition. Dryer monitor 20 may further calculate energy usage and energy cost information based on the amount of time dryer operates in an overdry condition. This information may be useful to managers of commercial laundry establishments to monitor and track excess energy usage and generally monitor operating conditions of the dryer.

Dryer monitor 20 may also activate a low battery indicator upon detection of a low battery condition. For example, low battery indicator 37C may light up or blink to alert laundry staff of the low battery condition.

Status indicators 37 and/or the audible alarm may run continuously, may blink or may be activated on an intermittent basis, such as every few minutes, to save battery life. A reset button 33 restarts the cycle count after the maximum number of cycles has been reached and the corresponding action has been completed, such as replacement of the multi-cycle laundry product, preventive maintenance, etc., and/or may reset the overdry indicator.

Figure 3:
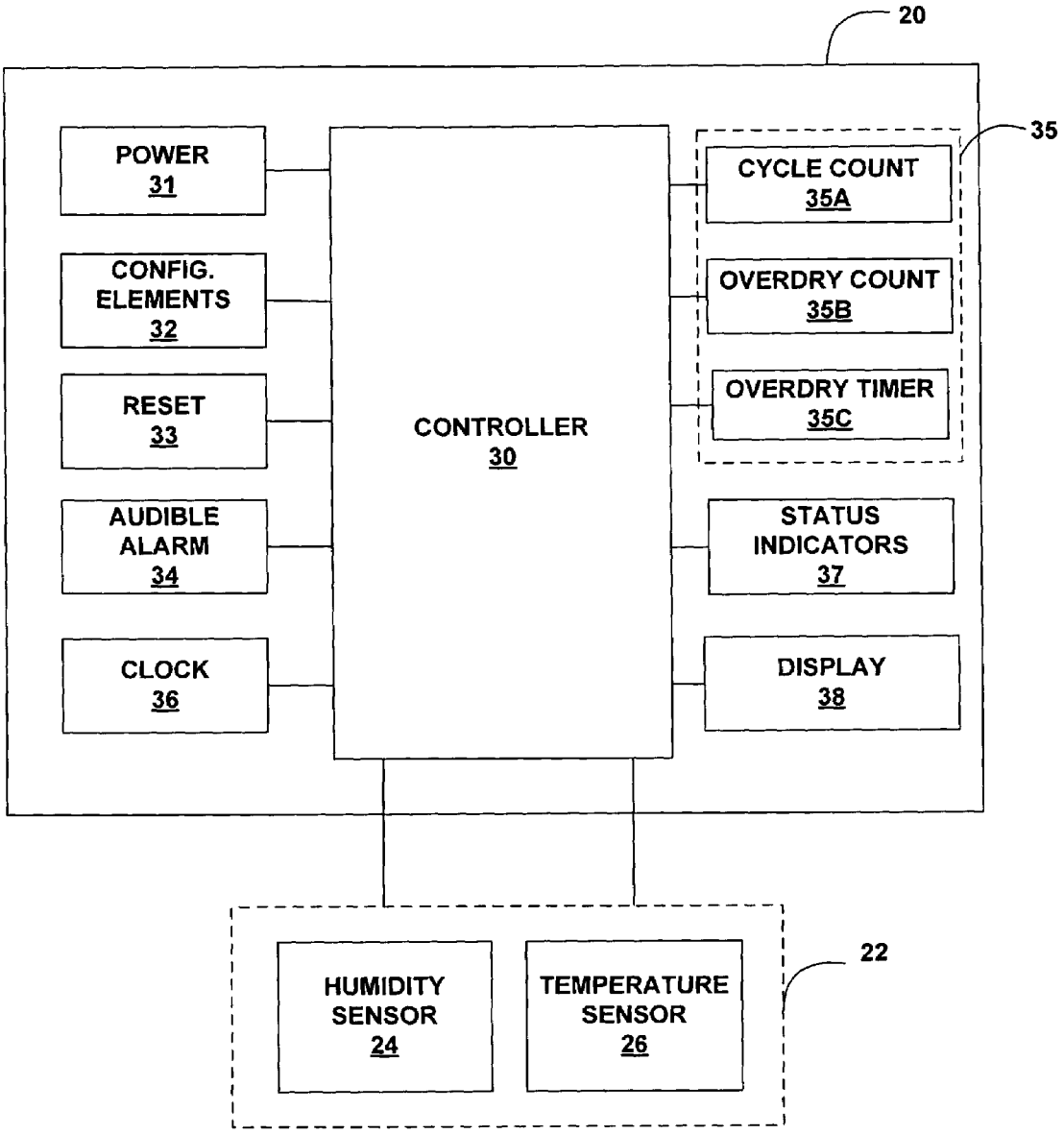
FIG. 3 is a block diagram illustrating an example embodiment of a dryer monitor.

FIG. 3 is a block diagram illustrating an example embodiment of dryer monitor 20. In this example embodiment, dryer monitor 20 is a battery powered circuit containing an embedded microcontroller 30 that monitors the outputs of sensor(s) 22. Controller 30 also controls audible and visual alarm outputs. Specifically, a controller 30 may receive dryness and/or dryer cycle start/finish information, or both from sensor 22. Controller 30 determines the dryness of the textiles in the dryer based on the dryness information obtained from sensor 22. Controller 30 may also determine the start and/or finish of a dryer cycle based on the dryer cycle start/finish information obtained from sensor 22, and further may count dryer cycles and/or keep track of the number of dryer cycles that have occurred within a defined period of time.

Sensor 22 may include a humidity sensor 24, a temperature sensor 26 and/or other type of sensor capable of sensing information useful in determining either when the textiles within the dryer are "dry," determining when the textiles are "overdry" and/or determining the start or finish of a dryer cycle. In one embodiment, controller 30 determines the "dryness" of textiles in a dryer based on humidity information obtained from humidity sensor 24. In another embodiment, controller 30 determines the start and/or finish of a dryer cycle based on information obtained from temperature sensor 26. In one embodiment, humidity sensor 24 and temperature sensor 26 are positioned to sense humidity and temperature information of exhaust air of the clothes dryer 2.

Dryer monitor 20 is a diagnostic device that can be used with any drying equipment. In one embodiment, for example, dryer monitor 20 may be an auxiliary device that may be added to dryers without dryness sensing capability. As such, dryer monitor 20 may include its own power supply 31. Power supply 31 may include, for example, 9V or AA, or other type of battery. In another embodiment, dryer monitor 20 may be integrated into a dryer at the time of manufacture. In that embodiment, dryer monitor 20 may be wired to receive power from dryer's power supply.

When dryer monitor 20 is used with an existing dryer in a commercial laundry setting, such as a hotel or commercial laundry establishment, a service technician configures dryer monitor 20 by determining and setting default settings for when the laundry is "dry" and/or a maximum number of dryer cycles after which dryer monitor should activate an alert. To that end, dryer monitor 20 may include configuration elements 32 via which a service technician may customize these and various other system parameters for each specific dryer installation. Configuration elements 32 may be implemented using dip switches, jumpers or the like. Alternatively, the system may be configured via software or pushbutton commands entered via the control panel 21, or may be auto-configured via NVRAM or other stored memory device.

Sensed and calculated information concerning the operation of dryer 2 are stored in a memory 35. Memory 35 may store, for example, any humidity and temperature information obtained from humidity sensor 24 and temperature sensor 26, as well as a time and date stamp associated with the humidity and temperature information. Memory 35 may also store, for example, computed information such as a dryer cycle count (stored in cycle count 35A) an overdry count (stored in overdry count 35B) and/or the amount of time the dryer has operated in an overdry condition (stored in overdry timer 35C). Memory 35 may also stored other computed information such as excess energy usage or excess energy cost corresponding to excess energy used during the amount of time the dryer has operated in an overdry condition.

In operation, controller 30 detects the start and/or a finish of a laundry cycle based on temperature information obtained from temperature sensor 26. The cycle count is maintained in cycle count 35A. Each time controller 30 detects the start of a dryer cycle, controller 30 updates the count stored in cycle count 35. The cycle count 35A may then be compared to the maximum cycle count as set up during installation of the dryer monitor 20 to determine how many cycles remain before the maximum cycle count is reached. Controller 30 may then display the remaining cycles on display 38. The displayed remaining cycle count may be used as a "countdown" from the maximum cycle count. For example, a displayed cycle count of zero may be indicate to laundry personnel that a multi-use laundry product should be replaced or that periodic maintenance should be performed. The countdown may also be indicative of any other status condition of a dryer as may be determined by those of skill in the art. Alternatively, the cycle count may be displayed as running total of the number of dryer cycles completed by the dryer.

Controller 30 determines when the laundry is "dry" based on humidity information obtained from humidity sensor 24. Controller 30 may also determine when the laundry is "overdry" based on information obtained from humidity sensor 24, or may determine that laundry is overdry a defined period of time after the laundry is determined to be dry. The number of overdry cycles is maintained in overdry count 36. Each time an overdry condition is detected, controller 30 updates the count stored in overdry count 35B. Information concerning the total number of overdry cycles executed by the dryer may be of interest to both individuals and commercial accounts alike, as in many cases dryer cycles run longer than actually required to completely dry the textiles. Prevention of such "overdry" conditions may help to conserve energy, reduce excess energy costs and prevent premature textile degradation and/or damage. Further, an overdry timer 35C may be used to track the amount of time dryer 2 operates in an overdry condition.

Reset 33, which may be a button, knob or other input element, may be used to reset the cycle count 35A once the maximum number of cycles has been reached, any multi-use laundry products have been replaced or other reason for monitoring the number of dryer cycles has been dealt with.

Reset 33 may also reset overdry indicator 37. A clock 36 is available to controller 30 for tracking progress of timers such as a start timer, a stop timer, an overdry timer, etc.

On dryers without automatic dryness sensing capability or when using a timer to set the length of time for a dryer cycle, the user must estimate the time it will take for the dryer achieve a desired level of dryness. In practice, this time to dryness is difficult to accurately determine. If the estimate is incorrect, the laundry may be "underdry" (still damp) or "overdry" (the cycle ran longer than required to adequately dry the textiles) at the conclusion of the dryer cycle. In the case of overdry, the textiles are subjected to the high heat of the dryer environment for an extended period of time and excess energy is consumed.

Dryer monitor 20 uses humidity as a benchmark to determine when the laundry is "dry." Dryer monitor 20 may then alert the user that the laundry is "dry" via status indicators 37, audible alarm 34 and/or display 38. In one embodiment, the dryness of textiles in a dryer is determined by sensing humidity levels in exhaust compartment 10 (see FIG. 1). For example, humidity sensor 24 may be a relative humidity (RH) sensor that measures the percent relative humidity (RH %) of exhaust air in exhaust compartment 10. Controller 30 may periodically sample the humidity information obtained by humidity sensor 24 or may collect it continuously in real time. In one embodiment, humidity sensor 24 is positioned on the output side of lint filter 10 and detects the humidity level as exhaust air enters exhaust compartment 10. However, it shall be understood that humidity sensor 24 may be positioned anywhere within exhaust compartment 10, may be positioned outside of lint compartment 10, on the inside of the lint filter, within drum 4, or at any other location outside of drum 4 without departing from the scope of the present invention.

To determine the correlation between humidity level in the exhaust compartment and "dryness," empirical data comparing textiles of different moisture content to determine what feels "dry" to a majority of test subjects was gathered. Prepared samples of various textile types (such as cotton and poly-blend) were removed from a dryer at various intervals during the course of a dryer cycle. The samples were analyzed for percent water content (weight % $H_2O$) and were evaluated by test subjects in a blind sensory test for "dryness." This analysis determined that a correlation exists between relative humidity in the exhaust compartment and a feeling of "dry" for a majority of test subjects. This correlation was found to be valid for a wide variety of load conditions and textile types (e.g., cotton, poly-blend, etc.). In other words, regardless of fabric type and time of cycle, the average RH % and a feeling of "dry" were the same for a variety of textile types. This direct correlation between RH % and a sensory feeling of "dryness" was generally the case even if the % $H_2O$ varies for different fabric types. Thus, the "dry" setting for humidity sensor 24 may result in "dry" laundry regardless of fabric type or load condition. A single default humidity set point may therefore be used to determine when laundry is "dry" for any load condition or fabric type.

In one embodiment, therefore, a default dry set point as a function of humidity (such as relative humidity, absolute humidity, or other humidity measure) may be set at the time of manufacture. During installation, the service technician may adjust and customize the dry set point as will be described further below to achieve a desired dryness level. The default dry set point may be set at the level at which a correlation exists between the measured humidity and an empirically determined feeling of dryness. This default dry set point may be, for example, a relative humidity of 13%, 12%, 11%, 10%, 9%, 8%, or less. The default dry set point and the adjusted dry set point may vary depending on the specific type of dryer with which dryer monitor 20 is being used, the location of humidity sensor 24 in the exhaust compartment, and various other factors.

A humidity set point for "overdry" may be set in a similar fashion. In other words, the overdry set point may be empirically determined using qualitative sensory data gathered from a sample of test subjects. Alternatively, the overdry set point may be set a few percentage points below the dry set point. A default overdry set point may be programmed at the time of manufacture, and, like the default dry set point, may be adjusted and customized at the time of installation or at some later time. The default dry and overdry set points may be (but need not necessarily be) adjusted as different dryers and different positioning of humidity sensor 24 may required different dry and overdry set points than the default levels set at the time of manufacture. As another alternative, controller 30 may determine that the laundry is "overdry" a defined period of time after the laundry has been determined to be "dry."

Figure 4:
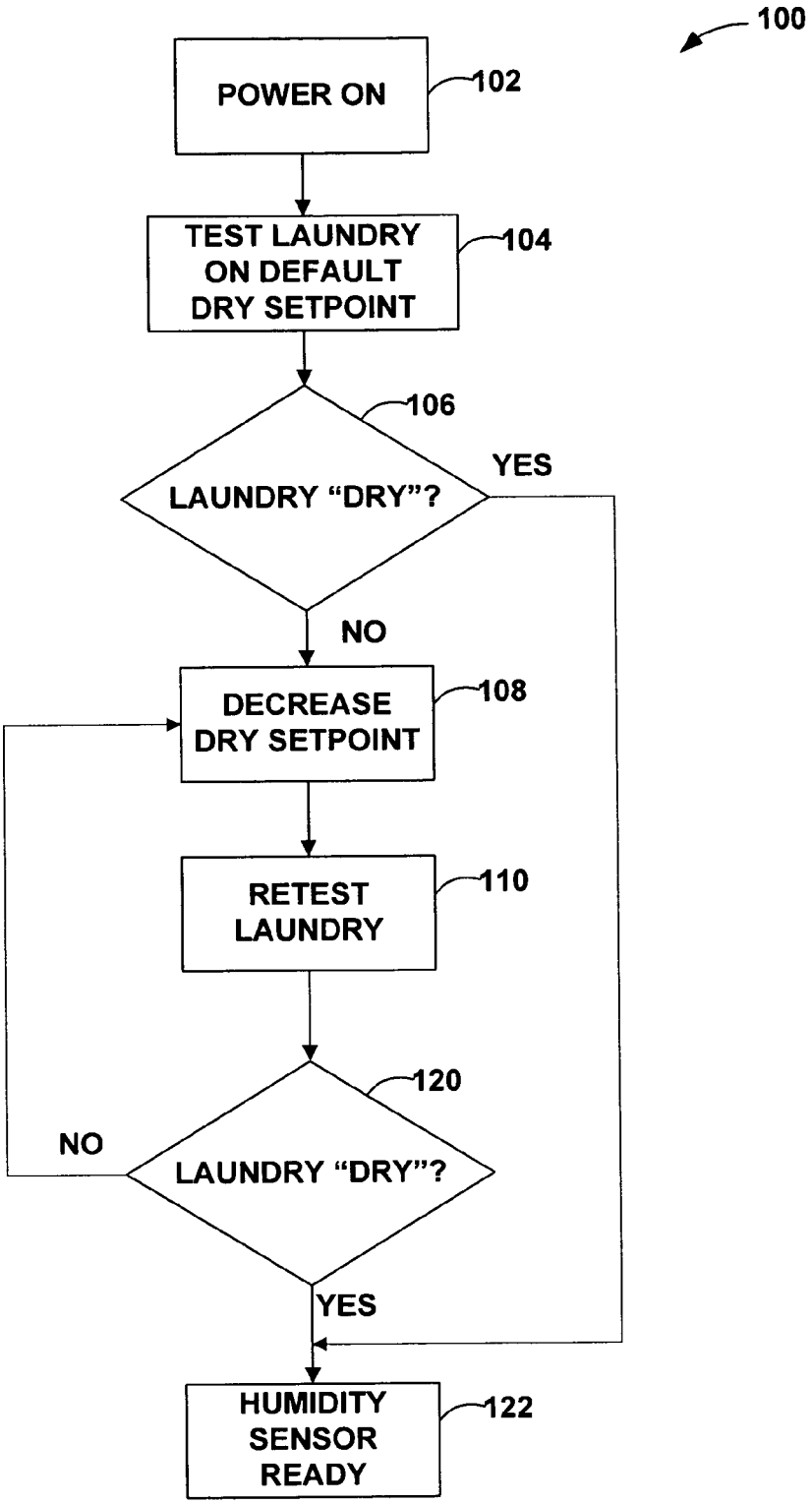
FIG. 4 is a flow chart illustrating an example initialization process for a dryer monitor.

FIG. 4 is a flow chart illustrating an example initialization process for dryer monitor 20. When dryer monitor 20 is installed, a service technician initially configures dryer monitor 20 by determining the appropriate dry and overdry set points that define when the laundry is "dry" and when the laundry is "overdry." Initialization process 100 begins when a service technician initially turns on the dryer monitor 20 battery pack (102). At the time of manufacture, dryer monitor 20 may be set with a default dry set point at which point dryer monitor 20 determines that the laundry is "dry." During initialization process 100, if customization of the dry set point is desired, dryer monitor 20 is initially tested using the default dry set point (104). To do this, the service technician checks the laundry and subjectively determines, by touch, whether the default dry set point adequately achieves a desired level of dryness in the opinion of the service technician (106). If not, the service technician may adjust the dry set point by decreasing the dry set point (108) and retesting the laundry (110). This process may be repeated until, in the opinion of the service technician, a desired level of dryness is achieved (120). Once the dry set point has been determined, the humidity sensor settings are fully initialized and the humidity sensor initialization process is complete (122).

If an overdry set point is desired, controller 30 may similarly proceed to determine an appropriate overdry set point. To do this, the service technician checks the laundry and subjectively determines, by touch, whether the default overdry set point adequately achieves a level of "overdry" in the opinion of the service technician. If not, the service technician may increase the default overdry set point and retest the laundry until, in the opinion of the service technician, the laundry is "overdry." Alternatively, controller 30 may determine an overdry condition a defined period of time after the laundry has been determined to be dry.

As described above, in certain situations it may be desirable to keep track of the number of dryer cycles completed by the dryer. For example, a dryer cycle count may be used to alert laundry personnel when it is time to replace a multi-cycle laundry product. As another example, a dryer cycle count may be used to alert laundry personnel when it is time to perform preventive maintenance. As another example, dryer cycle counts may be useful when users of a dryer are charged for use of the dryer on a per-cycle basis.

To that end, dryer monitor 20 may include a mechanism for counting dryer cycles. Controller 30 detects the start (beginning) of a dryer cycle, stop (end) of a dryer cycle or both based on temperature information received from temperature sensor 26. In one embodiment, dryer monitor 20 may simply count the total number of dryer cycles completed by the dryer over the lifetime of the dryer. In another embodiment, dryer monitor 20 may count the number of dryer cycles completed by the dryer during a defined period of time. In another embodiment, dryer monitor 20 may count a number of dryer cycles completed by the dryer and alert a user when a predetermined cycle count is reached. In another embodiment, dryer monitor 20 may display the counted number of dryer cycles. In another embodiment, dryer monitor 20 may display the number of dryer cycles remaining until the predetermined count is reached. In other words, dryer monitor 20 may display the difference between the counted number of dryer cycles and a maximum cycle count (a "countdown" of the number of dryer cycles). When the countdown reaches zero, dryer monitor 20 may activate a status indicator to alert laundry personnel that the desired number of dryer cycles have been completed. The status indicator or zero count on the display may further indicate that some action is to be taken with respect to the dryer, such as replacing a multi-use laundry product, perform preventive maintenance, etc.

Dryer monitor 20 detects the start (beginning) of a dryer cycle, stop (end) of a dryer cycle or both based on information received from temperature sensor 26. For example, temperature sensor 26 obtains temperature information concerning the dryer. In one embodiment, as discussed above with respect to FIGS. 1 and 3, temperature sensor 26 is located in exhaust compartment 8 of dryer 2. Temperature sensor 26 may be placed on the output side of lint trap 10, behind lint trap 10, or anywhere in exhaust compartment 8. Controller 30 may periodically sample temperature information from temperature sensor 26 or may continuously receive the temperature information from temperature sensor 26. In one embodiment, controller 30 detects the start of a dryer cycle when the sensed temperature exceeds a "start" temperature for a first predetermined period of time. Similarly, controller 30 may detect the completion of a dryer cycle when the sensed temperature is less than a "stop" temperature for a second predetermined period of time.

Figure 5:
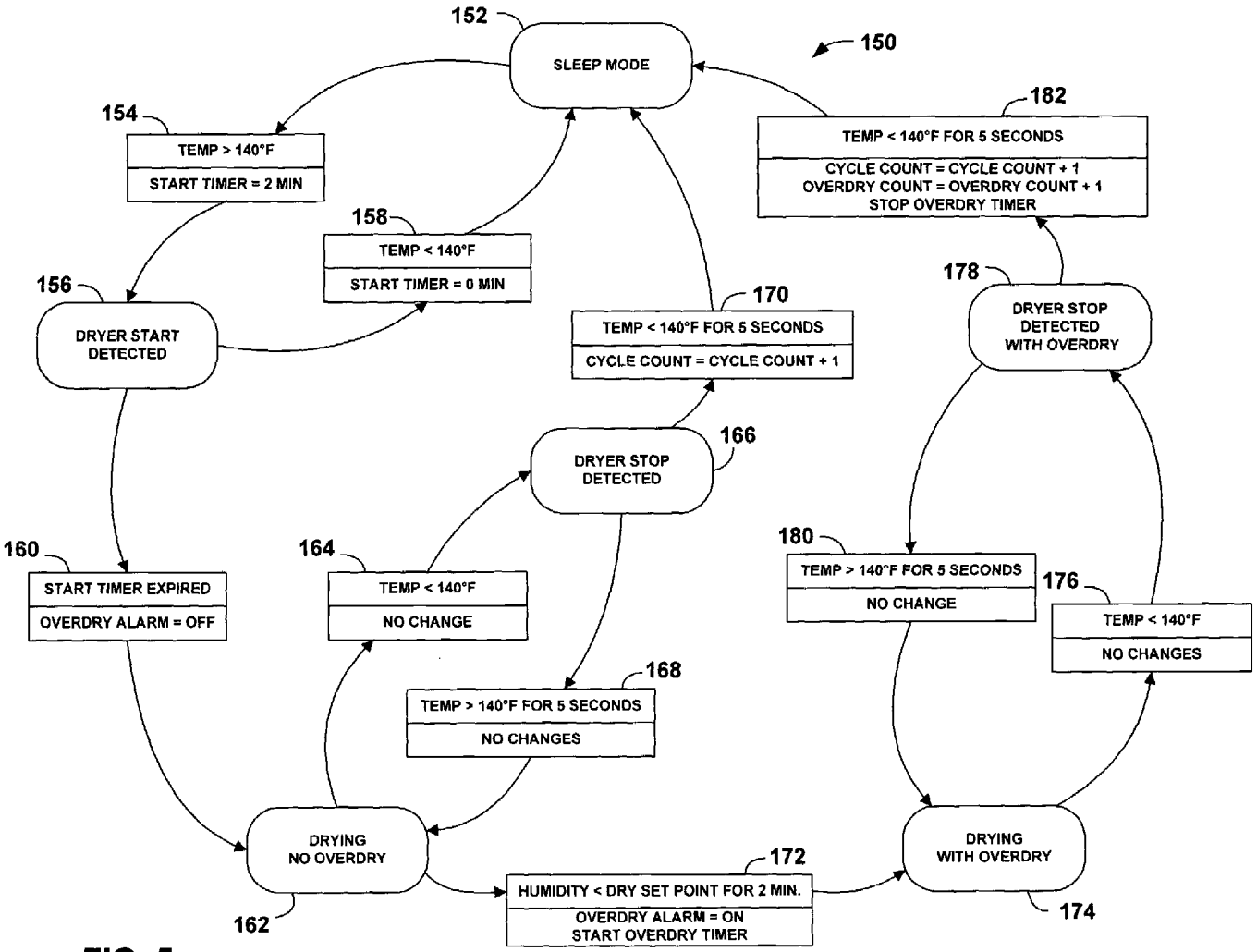
FIG. 5 is a flow chart illustrating an example process by which a dryer monitor may determine when textiles in a dryer are "dry," determine when textiles in a dryer are "overdry" and count dryer cycles.

FIG. 5 is a state diagram illustrating an example process 150 by which controller 30 determines when textiles in a dryer are "dry," determines when textiles in a dryer are "overdry" and counts dryer cycles. Although FIG. 5 illustrates determination of "dry," "overdry" and counting of dryer cycles, it shall be understood that dryer monitor 20 need not perform all of those tasks. Rather, dryer monitor 20 may determine dryness only, may count dryer cycles only, may determine dryness and overdryness only, or any combination thereof, without departing from the scope of the present invention.

Process 150 begins in a non-drying or "sleep" mode (152). Sleep mode conserves battery life when dryer 2 is not in use. When controller 30 receives information from the temperature sensor 26 indicating that the temperature is greater than a defined "start" temperature" (140° F. in this example) controller 30 activates a start timer for a defined "start period" (154) (2 minutes in this example). At this point controller 30 moves to a dryer start detected state (156). If at any time within the start period the temperature drops below the start temperature (158), controller 30 sets the start timer back to zero and goes back into sleep mode (152). If, on the other hand, the temperature remains above the start temperature for a period of time at least equal to the start period (160) controller 30 sets an overdry alarm status register "OFF" (160) and moves to a drying with no overdry state (162). Because this is the beginning of the dryer cycle, dryer monitor 20 defaults to a no overdry state at this point.

Once a dryer cycle start has been detected and the drying state is entered (162), controller 30 monitors temperature sensor 26 and humidity sensor 24 to detect either the end (stop) of the dryer cycle or the occurrence of an overdry condition. When controller receives information from temperature sensor 26 indicating that the temperature is less than a defined "stop temperature" (140° F. in this example) (164) controller 30 moves to a dryer stop detected state (166). If, while in the dryer stop detected state the temperature goes above the stop temperature for at least a defined stop period (5 seconds in this example) (168) controller 30 determines that the dryer cycle has not yet completed and moves back into the drying with no overdry state (162). If, on the other hand, while in the dryer stop detected state (166) the temperature stays below the dryer stop temperature for at least the defined stop period (170), controller 30 determines that the dryer cycle has completed. Controller 30 then increments the cycle count (170). Alternatively, controller 30 may increment the cycle count after detecting the start of the dryer cycle (156). Controller 30 then moves back into sleep mode (152).

While in the drying with no overdry state (162) controller 30 also receives humidity information from humidity sensor 24. Controller 30 compares the received humidity information with the dry set point to determine whether the laundry is dry. An overdry period (2 minutes in this example) is used to determine when the laundry is overdry. If the humidity remains less than the dry set point for at least the overdry period, controller 30 sets the overdry alarm status register to "ON" (172). Controller 30 may also start an overdry timer to track the amount of time the dryer remains in the overdry condition (172). In other words, controller 30 uses the overdry timer to track the amount of time the dryer continues to run after the items in the dryer are determined to be overdry. At this point, controller 30 moves to a drying with overdry state (174).

While in the drying with overdry state (174) controller 30 continues to monitor temperature sensor 26 to detect the completion (stop) of the dryer cycle. The overdry timer continues to track the amount of time the dryer remains in the overdry condition. When controller 30 receives information from temperature sensor 26 indicating that the temperature is less than the defined "stop temperature" (140° F. in this example) (176) controller 30 moves to a dryer stop detected with overdry state (178). If, while in the dryer stop detected with overdry state (178) the temperature goes above the stop temperature for at least a defined stop period (5 seconds in this example) (180) controller 30 determines that the dryer cycle has not yet completed and moves back into the drying with overdry state (174). If, on the other hand, while in the dryer stop detected with overdry state (178) the temperature stays below the dryer stop temperature for at least the defined stop period (182), controller 30 determines that the dryer cycle has completed. Controller 30 then increments the cycle count and increments the overdry count (182). Controller 30 also stops the overdry timer (182). Alternatively, controller 30 may increment the cycle count after detecting the start of the dryer cycle (156). Controller 30 then moves back into sleep mode (152).

Although specific values are given for the variables in FIG. 5, such as start temperature, start timer period, dry set point, stop timer period, overdry timer period, etc, it shall be understood that the values described for these variables are for example purposes only, and that other values could be substituted therefore without departing from the spirit and scope of the present invention. The values assigned to these variables may change depending upon the desired degree of dryness or overdryness, the location of sensor 22, etc.

In the embodiments shown and described above, dryer monitor 20 is associated with a single dryer 2. However, in alternate embodiments, dryer monitor 20 may be associated with multiple dryers 2. For example, dryer monitor 20 may receive information concerning the dryness of textiles from a plurality of sensors 22, wherein each of the plurality of sensors corresponds to a different one of a plurality of dryers 2. Similarly, dryer monitor 20 may receive information concerning the number of dryer cycles from a plurality of sensors 22, wherein each of the plurality of sensors corresponds to a different one of a plurality of dryers 2. In this way, dryer monitor 20 may determine and alert laundry personnel of the dryness of textiles for a plurality of dryers 2, or may determine and alert laundry personnel of the cycle count for a plurality of dryers 2. Such as feature may be useful, for example, in locations with more than one dryer, such as hotels or commercial laundry establishments. In this embodiment, dryer monitor 20 may be mounted on one of the plurality of dryers or may be located in a central control area rather than mounted on a dryer front.

Rather than using relative humidity to determine dryness of textiles in a dryer, dryer monitor 20 may also use absolute humidity or some other humidity measure as a benchmark to determine when laundry is dry and/or overdry. Similarly, dryer monitor 20 need not measure humidity levels in the lint compartment, but may measure humidity levels inside drum 4, behind lint screen 10, or other location with respect to dryer 2 where a humidity level capable of indicating dryness or overdryness of textiles in a dryer may be obtained. In this alternate embodiments, the dry and overdry humidity set points may be adjusted to best correspond to the feeling of dry or overdry depending upon the location of humidity sensor 24.

Further, other dryer settings in addition to "dry" and "overdry" may also be incorporated into dryer monitor 20. For example, there may be situations in which it is desired to remove laundry from a dryer while it is still damp. Alternatively, an alert at some intermediate point in the cycle may be desired if a laundry product is to be added to the dryer mid-cycle, a dryer setting (such as the heat setting) is to be changed mid-cycle, etc. In these cases, dryer monitor 20 could be set to alert at these intermediate points in the dryer cycle.

Dryer monitor 20 may further incorporate other features in addition to those described above. For example, dryer monitor 20 may include a timer that tracks the length in time of each dryer cycle, and/or tracks the total combined time of all dryer cycles in the lifetime of the dryer or since a defined point in time.

Dryer monitor 20 may also use the overdry timer which tracks the amount of time the dryer operates in the overdry condition to further calculate and store information concerning excess energy usage and the cost associated with that excess energy usage. For example, knowing the amount of time the dryer operates in the overdry condition (via overdry timer), and knowing certain specifications of the dryer such as average energy usage per unit time, dryer monitor 20 may calculate the amount of excess energy unnecessarily expended in the overdry condition (that is, continuing to operate the dryer after the laundry is already dry). In addition, knowing the rate of utility cost per unit time, dryer monitor 20 could also determine the cost of that excess energy usage. Tracking and reporting of excess energy usage and cost to management personnel may be very valuable for the overall management and operation of commercial laundry establishments.

In one embodiment, the invention may encompass one or more computer-readable media comprising instructions that cause a processor, such as controller 30, to carry out the methods described above. A "computer-readable medium" includes but is not limited to read-only memory (ROM), random access memory (RAM), non-volatile random access memory (NVRAM), electrically erasable programmable read-only memory (EEPROM), flash memory a magnetic hard drive, a magnetic disk or a magnetic tape, a optical disk or magneto-optic disk, a holographic medium, or the like. The instructions may be implemented as one or more software modules, which may be executed by themselves or in combination with other software. A "computer-readable medium" may also comprise a carrier wave modulated or encoded to transfer the instructions over a transmission line or a wireless communication channel.

The instructions and the media are not necessarily associated with any particular computer or other apparatus, but may be carried out by various general-purpose or specialized machines. The instructions may be distributed among two or more media and may be executed by two or more machines. The machines may be coupled to one another directly, or may be coupled through a network, such as a local access network (LAN), or a global network such as the Internet.

The invention may also be embodied as one or more devices that include logic circuitry to carry out the functions or methods as described herein. The logic circuitry may include a processor that may be programmable for a general purpose or may be dedicated, such as microcontroller, a microprocessor, a Digital Signal Processor (DSP), an Application Specific Integrated Circuit (ASIC), a field programmable gate array (FPGA), and the like.

One or more of the techniques described herein may be partially or wholly executed in software. For example, a computer-readable medium may store or otherwise comprise computer-readable instructions, i.e., program code that can be executed by a processor to carry out one of more of the techniques described above.

Various embodiments of the invention have been described. These and other embodiments are within the scope of the following claims.

The invention claimed is:

1. A device comprising:

a humidity sensor positioned outside a drying compartment of a dryer that senses humidity information concerning humidity levels associated with the dryer;

a temperature sensor that senses temperature information concerning a temperature associated with the dryer; and a controller that determines dryness of items in the dryer based on the sensed humidity information and that counts dryer cycles of the dryer based on the sensed temperature information;

wherein the controller further detects start of a dryer cycle when the temperature information indicates that a temperature associated with the dryer remains at least as high as a threshold start temperature for at least a defined start period of time.

2. The device of claim 1, wherein the controller further:

compares the temperature information with a predefined start temperature to detect a start of a dryer cycle;

compares the temperature information with a predefined stop temperature to detect a stop of a dryer cycle; and increments a cycle count after detecting the stop of the dryer cycle.

3. A device comprising:

a humidity sensor positioned outside a drying compartment of a dryer that senses humidity information concerning humidity levels associated with the dryer;

a controller that determines dryness of items in the dryer based on the sensed humidity information and determines whether the items in the dryer are overdry a defined period of time after the controller determines that the items in the dryer are determined to be dry.

4. The device of claim 3, wherein the controller further tracks an amount of time the dryer continues to run after the items in the dryer are determined to be overdry.

5. The device of claim 3, wherein the controller further counts dryer cycles of the dryer.

6. The device of claim 3, further including a temperature sensor that senses temperature information associated with the dryer, and wherein the controller counts dryer cycles based on the sensed temperature information.

7. The device of claim 6, wherein the controller further:

compares the temperature information with a predefined start temperature to detect a start of a dryer cycle; and increments a cycle count after detecting the start of the dryer cycle.

8. The device of claim 6, wherein the controller further detects start of a dryer cycle when the temperature information indicates that a temperature associated with the dryer remains at least as high as a threshold start temperature for at least a defined start period of time.

9. The device of claim 3, wherein the dryer is one of a clothes dryer, a dishwasher, a warewasher or a car wash.

10. The device of claim 3, wherein the items are textiles.

11. The device of claim 3, wherein the humidity sensor is one of a relative humidity sensor or an absolute humidity sensor.

12. The device of claim 3, where the dryer is a clothes dryer and the humidity sensor is positioned to sense humidity of exhaust air of the clothes dryer.

13. The device of claim 3, wherein the dryer is a clothes dryer and the humidity sensor is positioned in a lint compartment of the clothes dryer.

14. The device of claim 3, where the controller compares the sensed humidity level with a dry set point to determine the dryness of the items in the dryer.

15. An apparatus comprising:

a humidity sensor positioned outside a drying compartment of a dryer that senses humidity information concerning humidity levels associated with the dryer;

a temperature sensor that senses temperature information concerning a temperature associated with the dryer; and a controller that determines dryness of items in the dryer based on the sensed humidity information and that counts dryer cycles of the dryer based on the sensed temperature information, wherein the controller further determines whether the items in the dryer are overdry a defined period of time after the controller determines that the items in the dryer are dry and tracks an amount of time the dryer continues to run after the items in the dryer are determined to be overdry.

16. The device of claim 15, wherein the dryer is one of a clothes dryer, a dishwasher, a warewasher or a car wash.

17. The device of claim 15, wherein the items are textiles.

18. The device of claim 15, wherein the humidity sensor is one of a relative humidity sensor or an absolute humidity sensor.

19. The device of claim 15, where the dryer is a clothes dryer and the humidity sensor is positioned to sense humidity of exhaust air of the clothes dryer.

20. The device of claim 15, wherein the dryer is a clothes dryer and the humidity sensor is positioned in a lint compartment of the clothes dryer.

21. The device of claim 15, where the controller compares the sensed humidity information with a dry set point to determine the dryness of the items in the dryer.

22. The device of claim 21, wherein the dry set point is equal to or less than 13% relative humidity of exhaust air of the dryer.

23. The device of claim 15, wherein the controller further:

compares the temperature information with a predefined start temperature to detect a start of a dryer cycle; and increments a cycle count after detecting the start of the dryer cycle.

* * * * *